United States Patent [19]

Rossi

[11] 3,966,428

[45] June 29, 1976

[54] ETHYLENE BACKBONE POLYMERS IN COMBINATION WITH ESTER POLYMERS HAVING LONG ALKYL SIDE CHAINS ARE LOW VISCOSITY DISTILLATE FUEL COLD FLOW IMPROVERS

[75] Inventor: Albert Rossi, Warren, N.J.

[73] Assignee: Exxon Research and Engineering Company, Linden, N.J.

[22] Filed: Oct. 31, 1973

[21] Appl. No.: 411,289

[52] U.S. Cl. ..... 44/62; 44/70; 44/80

[51] Int. Cl.[2] ..... C10L 1/18

[58] Field of Search ..... 44/62, 70, 80

[56] References Cited

UNITED STATES PATENTS

| | | | |
|---|---|---|---|
| 3,337,313 | 8/1967 | Otto | 44/62 |
| 3,443,917 | 5/1969 | Le Suer | 44/80 |
| 3,454,379 | 10/1964 | Isaacson et al. | 44/80 |
| 3,645,704 | 2/1972 | Burkard et al. | 44/62 |
| 3,661,541 | 5/1972 | Hollyday, Jr. | 44/62 |
| 3,765,849 | 10/1973 | Ilnyckyj et al. | 44/62 |

FOREIGN PATENTS OR APPLICATIONS

| | | | |
|---|---|---|---|
| 1,154,966 | 6/1969 | United Kingdom | 44/62 |

*Primary Examiner*—Allen B. Curtis
*Assistant Examiner*—Y. Harris-Smith
*Attorney, Agent, or Firm*—Frank T. Johmann

[57] ABSTRACT

Combinations of (A) an ethylene backbone polymer such as chlorinated polyethylene, or copolymers of 3 to 40 molar proportions of ethylene with a molar proportion of another monomer such as unsaturated esters, other olefins, vinyl chloride, etc., and (B) a polymer having long chain alkyl groups of 18 to 40 carbon atoms such as polymers of unsaturated esters, are cold flow improvers for low viscosity distillate fuel oils.

9 Claims, No Drawings

ETHYLENE BACKBONE POLYMERS IN COMBINATION WITH ESTER POLYMERS HAVING LONG ALKYL SIDE CHAINS ARE LOW VISCOSITY DISTILLATE FUEL COLD FLOW IMPROVERS

BACKGROUND OF THE INVENTION

1. Field of the Invention

The invention relates to additive combinations of an ethylene backbone type polymer and a second polymer having long linear alkyl side chains extending from ester groups, for improving the cold flow properties of low viscosity distillate fuel oil.

2. Prior Art

Various ethylene backbone polymers as pour point depressants for middle distillate fuel oil have been described in the patent literature. The more effective of these distillate oil pour depressants are copolymers of ethylene with various other monomers, e.g., copolymers of ethylene and vinyl esters of lower fatty acids such as vinyl acetate (U.S. Pat. 3,048,479); copolymers of ethylene and alkyl acrylate (Canadian Patent 676,875); terpolymers of ethylene with vinyl esters and alkyl fumarates (U.S. Pats. 3,304,261 and 3,341,309); polymers of ethylene with other lower olefins, or homopolymers of ethylene (British Patents 848,777 and 993,744); chlorinated polyethylene (Belgium Patent 707,371 and U.S. Pat. 3,337,313); etc.

In addition, various oil-soluble polymers characterized by long linear side chains extending from ester groups have recently become known as flow improvers for crude oils, residua-containing fuel oils, and in some cases, for distillate oils. One group of polymers described in British Patent 1,215,214 and U.S. Pat. 3,447,916 is prepared by condensation reactions of a dicarboxylic acid, or anhydride with a basic material which can be a polyol, polyamine or amino alcohol, together with a monocarboxylic acid. The resulting condensation polymer e.g., a polyester, is taught as a flow improver for residual and distillate fuel oils. A futher improvement of this type of flow improver condensation polymer is described in British Patent 1,215,214, wherein pentaerythritol is the polyol. Similarly, ester addition polymers having long linear side chains have been described in British Pats. 1,154,966, 1,161,188 and 1,197,474 as flow improvers for crude and residua-containing fuel oils. The most important of these addition polymers are prepared by polymerizing long chain unsaturated esters, such as copolymers of vinyl acetate and behenyl fumarate, or homopolymers of behenyl methacrylate, etc. Another class of addition polymers, which are taught as useful in residua are those described in South African Patent 70/6785, and published German Application 1,940,944. Here, long chain alpha olefins are copolymerized with maleic anhydride, which copolymer is then esterified with long straight chain alcohols.

More recently, synergistic combinations of various ethylene backbone pour point depressants with certain long chain ester polymers as flow improvers for residua containing fuels or distillates from flash distillation of residua, have been described in British Patent 1,300,227.

SUMMARY OF THE INVENTION

In contrast to said British patent directed to oils containing residua or residua components, the present invention is based upon the finding that a mixture of an aforedescribed middle distillate ethylene backbone pour depressant polymer with the aforedescribed long linear side chain ester polymers can give synergistic results in controlling the wax crystal size in light, low viscosity distillate fuel oils, which do not contain residuum and are not flashed distillates. This was surprising since the long side chain ester polymers per se have only a small effect on the wax crystals in middle distillate fuel oils containing no residua components.

In general, the compositions of the invention will comprise a light middle distillate fuel oil having a viscosity in the range of about 1.6 to 7.5 centistokes at 100°F., and which is free of residuum, or high boiling residuum components characteristic of flashed distillates, and a total amount of about 0.002 to 0.5, preferably 0.005 to 0.1 wt. %, of a mixture of the ethylene backbone polymer and the long side chain ester polymer in relative weight ratios of about 0.5 to 10, preferably 0.5 to 4 parts by weight of the ethylene polymer per part by weight of the long side chain polymer. Oil concentrates of 0.5 to 60 wt. % of said mixture of ethylene backbone polymer and long side chain polymer, in a distillate fuel oil, kerosene, an aromatic oil, etc. can be prepared for ease in handling by simply heating the oil and polymers to about 150°–250°F. to dissolve the polymers into the oil. All of said foregoing weight percents are based on the weight of the total composition.

Kerosene, which acts as a solvent for n-paraffin wax, had traditionally been a component of middle distillate fuel oils, e.g., diesel fuels and home heating oils. With the demands for kerosene for use in jet fuels, the amount of kerosene used in middle distillate fuel oils has decreased over the years. This, in turn, has frequently required the addition of wax crystal modifiers, e.g., pour point depressant additives, to the fuel oil to make up the lack of kerosene. The most effective of these are the ethylene backbone pour point depressants, and while very effective in lowering the pour point of distillate oil, they sometimes result in wax crystals having large particle sizes. These large particles tend to be filtered out by the screens and other filter equipment normally used on delivery trucks and fuel oil storage systems, with a resulting plugging of these screens and filters even though the temperature of the oil is substantially above its depressed pour point. The use of the inventive combination of ethylene backbone polymer with the long side chain polymer can better control the wax crystal size to overcome the plugging problem in heating oils and diesel fuels. This ability to prevent plugging is becoming of more importance in view of a tendency to increase the maximum atmospheric distillation temperature of some fuels, e.g., certain diesel fuels. However, raising the maximum distillation point will raise the pour point and the cloud point. While current diesel fuels usually have pour points on the order of −20°F., by increasing the distillation temperature, diesel fuels can have pour points as high as +5° or +10°F., or higher. Correspondingly, the cloud point is also increased as the cloud point is usually 3° to 15°F. higher than the pour point, although in some fuels, the cloud point may be as much as 25°F. above the pour point. The higher cloud point will usually mean that the wax crystals become more of a problem so that control of wax crystal size becomes more important. For example, in the normal operation of diesel trucks, the diesel engine is usually provided with a fine mesh filter of about 50 microns, e.g., about equivalent to a 270 mesh screen, ahead of the engine. In cold weather when the ambient temperature is below the cloud point, any wax crystals that form should be sufficiently fine so that they will pass through these filters. Similarly, in heating oil distribution systems, various fine screens or filters are often encountered.

The Distillate Fuel

The light fuel of the invention, which is improved in its cold flow characteristics by control of the wax crystal size, will have a viscosity in the range of 1.6 to 7.5 cs. at 100°F. and will be a middle distillate fuel boiling in the range of about 250°F. to about 750°F. The fuel oil can comprise straight run or cracked gas oil or a blend in any proportion of straight run and thermally and/or catalytically cracked distillates. Examples of such light distillate fuels are diesel fuels and low viscosity heating oils.

A typical specification for a diesel fuel includes a minimum flash point of 100°F., and a 90% distillation point between 540°F. and 640°F. (See ASTM Designations D-496 and D-975).

A typical heating oil specification calls for a 10% distillation point no higher than about 440°F., a 50% point no higher than about 520°F., and a 90% point of at least 540°F. and no higher than about 640°F. to 650°F., although some specifications set the 90% point as high as 675°F.

The Ethylene Backbone Pour Depressant

In general, these polymeric pour depressants have a polyethylene backbone which is divided into segments by hydrocarbon or oxy-hydrocarbon side chains. Generally, they will comprise about 3 to 40, preferably 4 to 20, molar proportions of ethylene per molar proportion of a second ethylenically unsaturated monomer, which latter monomer can be a single monomer or a mixture of such monomers in any proportion. These oil-soluble polymers will generally have a number average molecular weight in the range of about 500 to 50,000, preferably about 1,000 to about 6,000 as measured for example, by Vapor Pressure Osmometry, such as using a Mechrolab Vapor Pressure Osmometer Model 310A.

The unsaturated monomers, copolymerizable with ethylene, include unsaturated mono and diesters of the general formula:

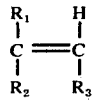

wherein $R_1$ is hydrogen or methyl; $R_2$ is a $—OOCR_4$ or $—COOR_4$ group wherein $R_4$ is hydrogen or a $C_1$ to $C_{16}$, preferably a $C_1$ to $C_4$, straight or branched chain alkyl group; and $R_3$ is hydrogen or $—COOR_4$. The monomer, when $R_1$ and $R_3$ are hydrogen and $R_2$ is $—OOCR_4$ includes vinyl alcohol esters of $C_2$ to $C_{17}$ monocarboxylic acids, preferably $C_2$ to $C_5$ monocarboxylic acid. Examples of such esters include vinyl acetate, vinyl isobutyrate, vinyl laurate, vinyl myristate, vinyl palmitate, etc. When $R_2$ is $—COOR_4$, such esters include methyl acrylate, isobutyl acrylate, methyl methacrylate, lauryl acrylate, $C_{13}$ Oxo alcohol esters of methacrylic acid, etc. Examples of monomers where $R_1$ is hydrogen and $R_2$ and $R_3$ are $—COOR_4$ groups, include mono and diesters of unsaturated dicarboxylic acids such as: mono $C_{13}$ Oxo fumarate, di-$C_{13}$ Oxo fumarate, di-isopropyl maleate; di-lauryl fumarate; ethylmethyl fumarate; etc.

Another class of monomers that can be copolymerized with ethylene include $C_3$ to $C_{16}$ alpha monoolefins, which can be either branched or unbranched, such as propylene, isobutene, n-octene-1, isooctene-1, n-decene-1, dodecene-1 etc.

Still other monomers include vinyl chloride, although essentially the same result can be obtained by chlorinated polyethylene, e.g., polyethylene of 10 to 30 wt. % chlorine content. Or even branched polyethylene can be used per se as the pour depressant.

These polymeric pour depressants are generally formed using a free radical promotor, or in some cases they can be formed by thermal polymerization, or they can be formed by oragno-metallic type of catalysts in the case of ethylene with other olefins. The polymers produced by free radical appear to be the more important and can be formed as follows. Solvent, and 0–50 wt. %, of the total amount of monomer other than ethylene, e.g., an ester monomer, used in the batch, are charged to a stainless steel pressure vessel which is equipped with a stirrer and cooling coil. The temperature of the pressure vessel is then brought to the desired reaction temperature, e.g., 70° to 250°C., and pressured to the desired pressure with ethylene, e.g., 800 to 10,000 psig., usually 900 to 6,000 psig. Then promoter, usually diluted with the reaction solvent, and additional amounts of the second monomer, e.g., unsaturated ester, are added to the vessel continuously, or at least intermittently, during the reaction time, which continuous addition gives a more homogeneous copolymer product as compared to adding all the unsaturated ester at the beginning of the reaction. Also during this reaction time, as ethylene is consumed in the polymerization reaction, additional ethylene is supplied through a pressure controlling regulator so as to maintain the desired reaction pressure fairly constant at all time. Following the completion of the reaction, usually a total reaction time of one-fourth to 10 hours will suffice, the liquid products are withdrawn from the pressure vessel, and the solvent removed by stripping, leaving the polymer as residue. Usually, to facilitate handling and later blending into oil, the polymer is dissolved in a light mineral oil to form a concentrate usually containing 10 to 60 wt. % polymer.

Generally, based upon 100 parts by weight of copolymer to be produced, then about 50 to 1220, preferably 100 to 600, parts by weight of solvent, e.g., hydrocarbons such as benzene, hexane, cyclohexane, etc., and about 0.1 to 20, e.g., 1 to 5, parts by weight of promoter will be used.

The promoter can be any of the conventional free radical promoters, such as peroxide or azo-type compounds, including the acyl peroxides of $C_2$ to $C_{18}$ branched or unbranched carboxylic acids, alkyl peroxides, etc., including di-benzoyl peroxide, di-tertiary butyl peroxide, di-tertiary butyl perbenzoate, tertiary butyl hydroperoxide, alpha, alpha', azo-diisobutyronitrile, di-lauroyl peroxide, etc.

Long Side Chain Ester Polymers

In general the oil soluble, long side chain flow improver polymers having ester groups which are useful in the invention will have number average molecular weights in the range of about 1000 to 100,000 and are more frequently in the range of about 2000 to 40,000. Usually at least 25 wt. %, e.g., 50 weight % or more, of the polymer will be in the form of long straight chain alkyl groups, generally of about 18 to 44, i.e., 20 to 40 carbon atoms. These polymeric flow improvers with long linear side chains are of three general types; namely, condensation polymers, ester addition polymers, and copolymers of esters and olefins, preferred forms of which are summarized below.

The Condensation Ester Polymers

These are preferably polymers of alkyl or alkenyl substituted dicarboxylic acid or anhydride wherein the alkyl or alkenyl group includes a linear portion of at least 16, and preferably 18 to 44 carbon atoms, with a polybasic material, e.g., polyol, and a $C_{20}$ to $C_{44}$ straight chain, saturated, monocarboxylic acid.

The substituted dicarboxylic acids, or their anhydrides can be represented by the general formulae:

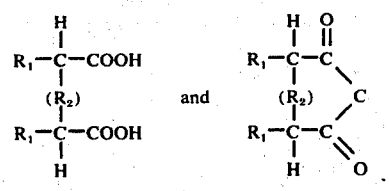

wherein each $R_1$ can be hydrogen or a hydrocarbon group such as an alkenyl group or alkyl group of 1 to 44 carbon atoms, with at least one of said $R_1$ including a $C_{16}$ to $C_{44}$ linear group. Preferably $R_2$ is a saturated aliphatic carbon group of 0 to 6 carbon atoms. A ready source of the acid or anhydride can be readily made by the reaction of an olefin with maleic anhydride, e.g., the reaction of $C_{22}$ alpha monoolefin and maleic anhydride.

The polyol includes polyhydric aliphatic alcohols having 2 to 6 hydroxy groups and a total of 2 to 12, e.g., 4 to 8, carbon atoms. Examples of such alcohols include ethylene glycol, glycerol, sorbitol, pentaerythritol, dipentaerythritol, polyethylene glycols, etc.

The monocarboxylic acid is a $C_{20}$ to $C_{44}$ acid of the formula $R_3COOH$ wherein $R_3$ is a straight chain $C_{19}$ to $C_{43}$ alkyl group. Examples of suitable acids include behenic acid, tetracosanoic acid, triacetonic acid, etc. Mixtures of monocarboxylic acids may be used.

In order to prepare the polymer, the three components are condensed with one another, preferably in equimolar quantities but small variations from equimolar quantities can readily be used, e.g., 0.8 to 1.6 moles of dicarboxylic acid or anhydride, reacted with 0.8 to 1.2 moles of polyol, and 0.7 to 2.2 moles of monocarboxylic acid. Processes for preparing these polymers are described in detail in the aforesaid U.S. Pat. 3,447,916, and essentially simply involve heating the monomers together in a condensation reaction and removing water until the desired molecular weight is achieved. Usually, to minimize gelling due to cross-linking, the polyol and monocarboxylic acid may be premixed and then added to the dicarboxyl acid component.

Additional Polymers of Unsaturated Ester

As previously indicated, another useful class of polymers include polymers of long side chain unsaturated esters. These esters are generally unsaturated mono and diesters represented by the formula:

-continued

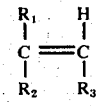

wherein $R_1$ is hydrogen or $C_1$ to $C_5$ alkyl groups; $R_2$ is $—OOCR_4$ or $—COOR_4$ group wherein $R_4$ is a $C_{20}$ to $C_{44}$, preferably $C_{20}$ to $C_{30}$, straight chain alkyl group; and $R_3$ is hydrogen or $—COOR_4$. The monomer, when $R_1$ is hydrogen and $R_2$ is $—OOCR_4$ includes vinyl alcohol esters of monocarboxylic acids. Examples of such esters include vinyl behenate, vinyl tricosanote, etc. When $R_2$ is $—COOR_4$, such esters include behenyl acrylate, behenyl methacrylate, tricosanyl acrylate, tricosanyl methacrylate, etc. Examples of monomers where $R_1$ is hydrogen, and $R_2$ and $R_3$ are both $—COOR_4$ groups, include: esters of unsaturated dicarboxylic acids such as eicosyl fumarate, docosyl fumarate, eicosyl maleate, docosyl citraconate, docosyl maleate, eicosyl citraconate, docosyl itaconate, tricosyl fumarate, tetracosyl maleate, pentacosyl citraconate, hexacosyl mesaconate, octacosyl fumarate, noncosyl maleate, triacontyl citraconate, hentriaconyl mesaconate, triacontyl fumarate, etc.

The long chain aliphatic esters described above may be prepared from aliphatic alcohols containing from 20 to 44 carbon atoms per molecule. Saturated aliphatic alcohols containing from 20 to 30 carbon atoms per molecule are preferred. Mixed esters derived by the reaction of the acids with a mixture of alcohols may be used, and one may also use a mixture of alcohols wherein a minor amount of the alcohol contains shorter chain alcohols, e.g., 1 to 19 carbon atoms per molecule. Examples of alcohols suitable for use in producing the esters include straight chain normal primary alcohols such as eicosyl, docosyl, tricosyl, tetracosyl, pentacosyl, hexacosyl, heptacosyl, octacosyl noncosyl, and triacontyl alcohols, etc.

Commercially marketed mixtures of alcohols consisting essentially of saturated alcohols of the requisite chain length may be employed in preparing the long chain esters. One such mixture is marketed under the trade name Behenyl alcohol and is a mixture of alcohols derived from natural sources, and consists primarily of docosyl alcohol but contains minor amounts of other alcohols containing from 16 to 24 carbon atoms per molecule.

Short chain unsaturated esters, having the above-noted formula but wherein $R_4$ has less than 20 carbons, preferably 1 to 5 carbons, in amounts of 20 to 80 molar %, based on the total polymer, can be copolymerized with the long chain unsaturated esters. For example, monomers such as vinyl acetate can be copolymerized with di-behenyl fumarate.

The ethylenically unsaturated monomers described in the preceding paragraphs are polymerized in a conventional manner. For example, the polymerization reaction may be carried out without diluent or in a solution of a hydrocarbon solvent such as heptane, benzene, cyclobenzene or white oil at a temperature in the range of from 60°F. to 250°F. and may be promoted by a peroxide type catalyst such as benzoyl peroxide, a hydroperoxide or an azo catalyst such as alpha - alpha' - azo - bis - isobutyronitrile. It is generally preferred to carry out the polymerization reaction under a blanket of an inert gas such as nitrogen in order to exclude oxygen. The polymerization time may vary from 1 to 36 hours.

Copolymers of Unsaturated Esters and Olefins

Another class of useful addition polymers are those of an unsaturated ester and an alpha-olefin. These can be prepared by direct copolymerization of the olefin and ester. However, it is usually easier to polymerize the olefin with unsaturated acid, preferably a dicarboxylic acid, and then esterify with alcohol.

Suitable ethylenically unsaturated dicarboxylic acids have 4 to 10 carbons and include maleic acid, fumaric acid, mesaconic acid, citraconic acid, itaconic acid, trans and cis-glutaconic acids. The corresponding anhydrides (where they exist) can also be used. Preferred is maleic anhydride.

The ethylenically unsaturated dicarboxylic acid, or ahydride or derivative thereof is reacted with an aliphatic olefin containing 18 or more carbon atoms per molecule. Although there is no upper limit to the number of carbon atoms per molecule, in practice olefins containing between 18 and 46, e.g., between 18 and 32, carbon atoms per molecule will generally be used. Mixtures of olefins may be used, e.g., a $C_{22}$-$C_{28}$ mixture. Suitable olefins include 1-alkenes, 2-alkenes and the like, including the $C_{20}$-$C_{46}$ alpha monoolefins described in detail above.

The reaction between the dicarboxylic acid or anhydride, and olefin usually in about equal molar proportions, can conveniently be carried out by mixing the olefin and acid material usually in about equimolar amounts, and heating the mixture to a temperature of at least 180°F., preferably at least 180°F., preferably at least 250°F. A free radical polymerization promoter such as t-butyl hydroperoxide or di-ti-butyl peroxide is normally used. The addition product thus prepared is reacted with about 0.5 to 1.0 molar proportions of alcohol, per molar proportion of dicarboxylic acid or anhydride, containing 20 to 44 linear carbons. Such alcohols include eicosanol, $C_{22}$ Oxo alcohol, tetracosanol, as well as those previously described, and may include mixtures of such alcohols, for example commercial behenyl alcohol derived from rapeseed oil.

The polymeric additive blends of the invention can be used in combination with still other additives, e.g., rust inhibitors, antioxidants, sludge dispersants, etc.

The invention will be further understood by reference to the following examples which include a preferred embodiment of the invention.

EXAMPLES

The following polymers were used:

Ethylene Backbone Polymers

Polymer A was an ethylene-vinyl acetate random copolymer having a number average molecular weight of about 1900 as determined by Vapor Pressure Osmometry (VPO) having about 1.5 methyl terminated branches (exclusive of the methyl groups in the vinyl acetate) per 1,000 molecular weight of polymer, and about 38 wt. % vinyl acetate. The copolymer was prepared by copolymerizing ethylene and vinyl acetate with dilauroyl peroxide at a temperature of about 105°C., under about 1050 psig ethylene pressure in cyclohexane solvent. A typical laboratory preparation of this polymer is as follows:

A three liter stirred autoclave is charged with about 1000 ml. of cyclohexane as solvent and about 100 ml. of vinyl acetate. The autoclave is then purged with nitrogen and then with ethylene. The autoclave is then heated to 105°C. while ethylene is pressured into the autoclave until the pressure is raised to about 1050 psig. Then, while maintaining a temperature of 105°C. and said 1050 psig pressure, about 160 ml/hour of vinyl acetate and about 80 ml/hour of solution consisting of 9 wt. % di-lauroyl peroxide dissolved in 91 wt. % cyclohexane is continuously pumped into the autoclave at an even rate. A total of 320 ml. of vinyl acetate and 11 gm. of peroxide are injected into the reactor over a period of about 2 hours. After the last of said peroxide is injected, the batch is maintained at 105°C. for an additional 10 minutes. Then, the temperature of the reactor contents is lowered to about 60°C., the reactor is depressurized, and the contents are discharged from the autoclave. The emply reactor is rinsed with 1 liter of warm benzene (about 50°C.) which is added to the product. The product is then stripped of the solvent and unreacted monomers on a steam bath overnight by blowing nitrogen through the product.

Further examples of this class of polymer is described in Canadian Patent 882,194. Details of measuring the branching of this type of polymer are given in Journal of Applied Polymer Science, Vol. 15, pp. 1737–1742 (1971).

Polymer B was a random copolymer of ethylene and isobutyl acrylate in a relative mole ratio of about 7 molar proportions of ethylene per molar proportion of isobutyl acrylate, said copolymer having a number average molecular weight (VPO) of about 3,000.

Polymer C was a random copolymer of ethylene and propylene in a relative mole ratio of about 7 molar proportions of ethylene per molar proportion of propylene, said copolymer having a number average molecular weight (VPO) of about 2500.

Polymer D was a polyethylene having a number average molecular weight (VPO) of about 5100 and a chlorine content of about 21 wt. %.

Long Side Chain Polymers

Polymer E was an addition polymer of $C_{22-28}$ alpha-monoolefin, maleic anhydride and behenyl alcohol. A typical laboratory preparation of this polymer follows.

To a 500 ml. 4-necked flask having a stirrer, thermometer, and charging funnel were added: 129 gms. (1.30 mole) of maleic anhydride and 458 gms. (1.25 moles) of a $C_{22-28}$ alpha olefin mixture. The reactants were heated to 145°C. and di-t-butyl peroxide was added at a rate of 2 gms. per hour for a period of 6 hours. The reaction was terminated after 6 hours by the addition of 580 gms. of Solvent 150 Neutral, which is a light mineral lubricating oil. The copolymer, dissolved in the oil, was then esterified by the addition of 424 gms. (1.3 moles) of a commercial behenyl alcohol, then followed by heating for 8 hours at 300°F., while removing the water of reaction by bubbling nitrogen through the reaction mixture. Additional oil was added to give a concentrate of 50 wt. % oil and 50 wt. % reaction product.

28.9 gms. of the oil concentrate was dialyzed for 6 hours with boiling hexane solvent at 70°C. in a Soxhlet extraction device, using a semi-permeable rubber membrane, to remove low molecular weight components, e.g., the oil, unreacted monomer, etc. 9.9 gms. of residue, representing the polymer, was obtained having a number average molecular weight of 2,800 by Vapor Pressure Osmometry.

The $C_{22-28}$ alpha olefin mixture that was used had a typical analysis of about 90 wt. % olefin and about 10 wt. % of non-olefinic material, e.g., paraffins, and was prepared by the growth reaction of ethylene with an organic metallic catalyst. The 90 wt. % olefin fraction was about 50 wt. % alpha monoolefin, about 25 wt. % of cis, trans olefin of the formula R—CH=CH—R, and about 15 wt. % of 1,1 dialkyl olefin of the structure

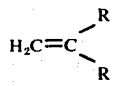

wherein each R represents varying alkyl groups. Since said $C_{22-28}$ olefin mixture was a distillation cut, the total carbons in the various types of olefin molecules was primarily 22 to 28 carbons. Analysis of the aforesaid 50 wt. % alpha monoolefin portion indicated a typical distribution as follows: about 32 wt. % n-$C_{22}$ alpha olefin, about 35 wt. % n-$C_{24}$ alpha olefin, about 22 wt. % n-$C_{26}$ alpha olefin, about 8 wt. % n-$C_{28}$ alpha olefin and about 3 wt. % $C_{30+}$ alpha olefin.

The commercial behenyl alcohol that was used was a mixture of straight chain alcohols derived from rapeseed oil and containing about 16 wt. % of $C_{18}$ alcohol, about 15 wt. % of $C_{20}$ alcohol and about 69% of $C_{22}$ alcohol.

Polymer F - This polymer was prepared in the same general manner as Polymer E except that about 2.6 moles of the behenyl alcohol was used in order to completely esterify the maleic anhydride moiety.

Polymer G - This was a condensation polymer of about 1.0 molar proportion of a mixed $C_{18}$ and $C_{22-28}$ alkenyl succinic anhydride, about 1.0 molar proportions of trimethylolpropane and about 1.0 molar proportions of a mixture of $C_{20-22}$ fatty acids. This polymer, having a number average molecular weight of about 3000 (Vapor Pressure Osmometry) was prepared by reacting all the raw materials together at 200°C. for 6 hours with distillation of the eliminated water. The alkenyl succinic anhydride was prepared by reacting maleic anhydride with an olefin mixture consisting of about 40 wt. % of $C_{18}$ $\alpha$-olefin and about 60 wt. % of the aforedescribed $C_{22-28}$ olefin. The $C_{18}$ $\alpha$-olefin comprised about 92 wt. % $C_{18}$ $\alpha$-olefin, with the remainder being a mixture of internal mono-olefins, paraffins, and dimers, each having about 18 carbons.

The $C_{20-22}$ fatty acid was a commercial straight chain saturated acid, which had an iodine number of 4.7, a total acid number of 164, and a Sap. No. of about 170. Analysis showed a carbon distribution as follows: $C_{16}$-2.2 wt. %; $C_{18}$-2.9; $C_{20}$-38.8; $C_{22}$-53.2; and $C_{24}$-1.8, with the remaining 1.1 wt. % indicated as isomers, e.g., branched chain acids.

Polymer H - This was an addition polymer of a $C_{20-22}$ dialkyl fumarate and vinyl acetate prepared as follows.

A 4-neck reaction flask equipped with an electric heating mantle, stirrer, charging funnel, thermometer, condenser and a Dean-Starke water trap, was charged with: 179 gms. of a $C_{22+}$ alcohol, 33.25 gms. of fumaric acid, 2.0 gms. of p-toluene sulfuric acid as esterification catalyst and 25 ml. hexane. The flask contents were heated in the range of 114° to 140°C. over the course of several days for a total of about 15 hours, during which time a total of 6.5 cc. of water collected in the trap by azeotropic distillation. After about the eighth hour of heating, an additional 0.5 gms. of said catalyst was added, while an additional 10 cc. of hexane was added after about the tenth hour.

At the end of said 15 hours, the flask was drained and the ester product was cooled in the flask while stirring with hot tap water for a short time, followed by turning off the stirrer so the water layer would separate, drawing off the bottom layer through a bottom drain in the flask. Then the aforesaid procedure was repeated with a dilute NaOH solution (about 7 gms. NaOH dissolved in about 170 ml. water and 30 ml. isopropyl alcohol) and again with hot tap water, to thereby neutralize and remove the catalyst.

The washed ester product above was charged to a polymerization flask equipped with a bottom drain, electric heating mantle, stirrer, thermometer, dropping funnel, and an overhead condenser, together with a nitrogen line fixed to the condenser. 18.2 gms. of vinyl acetate was also charged to the flask and nitrogen was bled through the system to evacuate it of air. Then 0.5 gms. of Lucidol 70 (70 wt. % benzoyl peroxide in 30 wt. % water) was added as a polymerization free radical promoter. The flask was heated for a total period of about 16 hours over three working days, while maintaining a temperature of about 80°C. and maintaining the nitrogen blanket. After the fourth hour of heating, another 0.2 gms. of the Lucidol 70 was added. The reaction was followed with a polarograph, i.e., periodically samples were taken and checked on the polarograph, which gave an indication of the free fumarate remaining, i.e., fumarate not yet polymerized. At the end of said 16 hours operating time, the polarograph indicated that a 90+% conversion of the fumarate had occurred and the reaction was stopped. A 20.5 gms. sample of the copolymer product was dialyzed for nine hours in boiling hexane using a semipermeable rubber membrane to hold said sample in a Soxhlet extraction device. This leached out low molecular weight components, e.g., unreacted monomer. 13.8 gms. of residue, representing the polymer, was obtained having a molecular weight of about 10,000 by VPO.

The $C_{22+}$ alcohol was the synthetic material made by the growth reaction of ethylene using an organic metallic catalyst which is oxidized off to make the alcohol. This $C_{22+}$ alcohol had been recrystallized from methyl ethyl ketone to eliminate some of the impurites. The $C_{22+}$ alcohol that was used was a mixture of saturated straight chain alcohols distributed as follows: $C_{22}$-46.6 wt. %; $C_{24}$-22.4 wt. %; $C_{26}$-7.9 wt. %; $C_{28}$ and higher 2.8 wt. %. The other 20.5 wt. % was the impurites still remaining after said recrystallization and was a mixture of paraffins, olefins, carbonyl compounds, etc. from the above-noted synthesis.

Polymer I - This was a condensation polymer of about 1.45 molar proportions of a $C_{30+}$ alkenyl succinic anhydride, about 1.0 molar proportion of pentaerythritol and about 1.9 molar proportions of a mixture of $C_{20}$-$C_{22}$ fatty acids. This copolymer was prepared by reacting the above-noted materials together at about 200°C. for about 6 hours under distillation to remove the eliminated water.

The molecular weight, after dialysis to remove unreacted and low molecular weight components, was about 5000 number average by Vapor Pressure Osmometry.

The $C_{20-22}$ fatty acid mixture was that previously described. The $C_{30+}$ alkenyl succinic anhydride was prepared by reacting a $C_{30+}$ commercial alpha olefin mixture with maleic anhydride. The $C_{30+}$ olefin mixture was a commercial material having an iodine number of about 40, comprising principally alpha monoolefin distributed as follows: about 9 wt. % $C_{26}$, about 6 wt. % $C_{28}$, about 14 wt. % $C_{30}$, about 13 wt. % $C_{32}$, about 11 wt. % $C_{34}$ and about 15 wt. % $C_{36}$ and higher alpha monoolefin. The remainder was a mixture of paraffins, internal monoolefins and diolefins. All of the preceding weight percents are based on the weight of the total commercial mixture.

The Fuels

Two middle distillate fuel oils (Fuel A and Fuel B) were used in the Examples, which had the following characteristics.

| | Fuel A | Fuel B |
|---|---|---|
| Sp. Gravity at 60°F. | 0.8401 | 0.8415 |
| Cloud Point, °F. | 28 | 28 |
| Pour Point, ASTM-D-97 | +20 | +5 |
| Flash Point, (PM) °F. | 170 | — |
| Viscosity at 100°F., cs. | 3.57 | 2.81 |
| Aniline Point, °C. | 73.1 | 65.4 |
| Distillation, ASTM °F. | | |
| I.B.P. | 324 | 320 |
| 5% | 414 | 350 |
| 10% | 457 | 376 |
| 30% | 532 | 433 |
| 50% | 561 | 505 |
| 70% | 594 | 589 |
| 90% | 644 | 677 |
| 95% | 669 | 729 |
| F.B.P. | 700 | 731 |

Various blends of Polymers A to I, in Fuels A and/or B were made by simply dissolving the polymer in the fuel oil. This was done while warming, e.g., about 200°F., if the polymer per se was added, and stirring. In other cases, the B polymer was simply added with stirring to the fuel in the form of an oil concentrate, usually about 50 wt. % polymer dissolved in a light mineral oil.

The blends were then tested for their cold flow properties in the CFPPT described below.

The Cold Filter Plugging Point Test (CFPPT)

The cold flow properties of the blend were determined by the "Cold Filter Plugging Point Test" (CFPPT). This test is carried out by the procedure described in detail in "Journal of the Institute of Petroleum", Volume 52, Number 510, June 1966, pp. 173–185. In brief, the Cold Filter Plugging Point Test is carried out with a 45 ml. sample of the oil to be tested which is cooled in a bath maintained at about −30°F. Every two degrees' drop in temperature, starting from 4°F. above the cloud point, the oil is tested with a test device consisting of a pipette to whose lower end is attached an inverted funnel. Stretched across the mouth of the funnel is a 350 mesh screen having an area of about 0.45 square inch. A vacuum of about 7 inches of water is applied to the upper end of the pipette by means of a vacuum line while the screen is immersed in the oil sample. Due to the vacuum, oil is drawn across the screen up into the pipette to a mark indicating 20 ml. of oil. The test is repeated with each two degrees' drop in temperature until the oil fails to fill the pipette to the aforesaid mark due to clogging of the screen with wax crystals. The results of the test are reported as the "operability limit" or cold filter plugging point, which is the temperature in °F. at which the oils fails to fill the pipette in prescribed time.

The blends prepared and their test results are summarized in Tables I and II which follow.

TABLE I

EFFECT OF POLYMERS IN FUEL A

| Wt. % Polymer | Polymer | CFPPT, °F. |
|---|---|---|
| No additive | — | 28 |
| .025 | A | 14 |
| .025 | E | 16 |
| .025 | F | 20 |
| .025 | G | 16 |
| .025 | I | 20 |
| .0125 | A | 20 |
| .0125 | A | 12 |
| .0125 | E | |
| .0125 | A | 12 |
| .0125 | F | |
| .0125 | A | 12 |
| .0125 | G | |
| .0125 | A | 16 |
| .0125 | I | |

As seen by Table I, 0.025 wt. % of the ethylene backbone polymer, Polymer A, reduced the plugging point of Fuel A from 28°F. to 14°F., thus showing a considerable effect in reducing the wax crystal size that forms on cooling the oil. A like amount of the long side chain ester polymers, Polymers E, F, G and I reduced the plugging point down to 16° to 20° F. Use of 0.0125 wt. % of Polymer A reduced the plugging point from 28°F. to 20°F. However, combinations with the long side chain polymers in general, gave an enhanced result, for example, 0.025 wt. % of the mixture of 0.0125 wt. % of each of Polymers A and E gave a plugging point of 12°F. and was more effective than 0.025 wt. % of either Polymer alone. The degree of the improvement, varies with the polymers, for example, the combination of Polymers A and I in the proportions tested were less effective than the other polymer combinations shown, and generally each oil and polymer combination must be individually tested to determine the polymers and polymer concentration necessary for optimum response.

TABLE II

EFFECT OF POLYMERS IN FUEL B

| Wt. % Polymer | Polymer | CFPPT, °F. |
|---|---|---|
| No additive | — | 30 |
| .01 | B | 15 |
| .01 | C | 22 |
| .01 | D | 28 |
| .01 | H | 25 |
| .01 | I | 28 |
| .0075 | B | 18 |
| .0075 | B | 2 |
| .0025 | G | |
| .0075 | B | 10 |
| .0025 | J | |
| .0075 | C | 24 |
| .0075 | C | 10 |
| .0025 | G | |
| .0075 | C | 16 |
| .0025 | I | |
| .0075 | D | 28 |
| .0075 | D | 10 |
| .0025 | H | |
| .0075 | D | 12 |
| .0025 | I | |

As seen by Table II, the various combinations of the ethylene backbone polymers, Polymers B to D, with the long side chain polymers, Polymers H and I, were more effective than the individual polymers by themselves. Also, as indicated by Table II, the plugging point, which indicates the presence of sufficiently large wax crystals to be a potential source of trouble in the usual oils distribution system involving filters, screens, etc., can be considerably about the pour point, which in the case of Fuel B was +5°F.

What is claimed is:

1. A light middle distillate fuel oil having a viscosity in the range of about 1.6 to 7.5 centistokes at 100°F boiling in the range of 250° to 750°F, which has been improved in its low temperature flow properties by about 0.002 to 0.5 wt. % based on the weight of the total composition, of a synergistic flow improving mixture of 0.5 to 10 parts by weight of an oil soluble ethylene backbone middle distillate pour point depressing polymer having a molecular weight in the range of about 500 to 50,000 per part by weight of an oil soluble long side chain ester-containing polymer operable as a residua flow improver and having a molecular weight in the range of about 1000 to 100,000, wherein said ethylene backbone pour point depressant is selected from the group of polymers consisting of:

1. chlorinated polyethylene containing about 10 to 30 wt. % chlorine,
2. copolymers consisting essentially of 3 to 40 molar proportions of ethylene with a molar proportion of $C_3$ to $C_{16}$ alpha monoolefin, and
3. copolymers consisting essentially of 3 to 40 molar proportions of ethylene with a molar proportion of an ethylenically unsaturated alkyl ester of the formula:

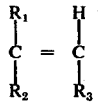

wherein $R_1$ is hydrogen or methyl, $R_2$ is a $—OOCR_4$ or $—COOR_4$ group wherein $R_4$ is hydrogen or a $C_1$ to $C_{16}$ alkyl group, and $R_3$ is hydrogen or $—COOR_4$;

wherein said long side chain ester containing polymer is characterized by at least 25 wt. % of the polymer being straight chain $C_{18}$-$C_{44}$ alkyl groups extending from ester linkages, said long chain ester polymer being selected from the group consisting of:

A. polyester condensation product of 0.8 to 1.6 molar proportions of an alkenyl or alkyl succinic anhydride or its corresponding acid containing a linear hydrocarbon group of 16 to 44 carbon atoms with 0.8 to 1.2 molar proportions of a polyol containing 2 to 6 hydroxy groups and a total of 2 to 12 carbon atoms, and 0.7 to 2.2 molar proportions of a $C_{20}$ to $C_{44}$ saturated aliphatic monocarboxylic acid;

B. addition polymers comprising moieties of long side chain unsaturated esters represented by the formula:

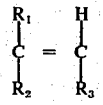

wherein $R_1$ is hydrogen or a $C_1$ to $C_5$ alkyl group, $R_2$ is a $—OOCR_4$ or $—COOR_4$ group wherein $R_4$ is a $C_{20}$ to $C_{44}$ straight chain alkyl group, and $R_3$ is hydrogen or $—COOR_4$; and C. polymers of about equi-molar proportion of $C_{18}$ to $C_{46}$ mono alpha aliphatic olefin with an unsaturated $C_4$ to $C_{10}$ dicarboxylic acid or anhydride and esterified with about 0.5 to 1.0 molar proportion of $C_{20}$ to $C_{40}$ linear, saturated, alcohol;

said synergistic flow improving mixtures being polymer combinations of: (1) and (B); (2) and (A); (3) and (A); and (3) and (C).

2. A fuel oil according to claim 1, wherein said ethylene backbone polymer is of group (3) and is a copolymer of ethylene and vinyl acetate.

3. A fuel oil according to claim 1, wherein said ethylene backbone polymer is of group (3) and is a copolymer of ethylene and isobutyl acrylate.

4. A fuel oil according to claim 1, wherein said ethylene backbone polymer is of group (1) and is polyethylene chlorinated to 10 to 30 wt. % chlorine.

5. A fuel oil according to claim 1, wherein said ethylene backbone polymer is of group (2) and is a copolymer of ethylene and propylene.

6. A fuel oil according to claim 1, wherein said long side chain polymer is of group (C) and is a copolymer of a $C_{22}$ to $C_{28}$ olefin with maleic anhydride esterified with behenyl alcohol.

7. A fuel oil according to claim 1, wherein said long side chain polymer is of group (A) and is a polyester condensation product of alkenyl succinic anhydride with trimethylolpropane and $C_{20}$ to $C_{22}$ fatty acid.

8. A fuel oil according to claim 1, wherein said long side chain polymer is of group (B) and is a copolymer of behenyl fumarate and vinyl acetate.

9. A fuel oil according to claim 1, wherein said long side chain polymer is of group (A) and is the condensation product of alkenyl succinic anhydride with pentaerythritol esterified with $C_{20}$ to $C_{22}$ fatty acid.

* * * * *